United States Patent [19]

Breon

[11] 4,388,741

[45] Jun. 21, 1983

[54] AUTOMATIC SEWER CLEANING SYSTEM

[75] Inventor: Everett C. Breon, Houston, Tex.

[73] Assignee: Kamal Banani Haghighi, Houston, Tex.

[21] Appl. No.: 219,827

[22] Filed: Dec. 24, 1980

Related U.S. Application Data

[63] Continuation-in-part of Ser. No. 71,501, Aug. 31, 1979, abandoned.

[51] Int. Cl.[3] ..... B08B 9/06

[52] U.S. Cl. ..... 15/104.3 SN; 15/246; 15/104.1 R; 4/255

[58] Field of Search ..... 4/191, 211, 255–257; 15/104.1 R, 104.09, 104.12, 104.3, 104.3 SN, 236 C, 241, 242, 249, 246

[56] References Cited

U.S. PATENT DOCUMENTS

| | | | |
|---|---|---|---|
| 1,306,925 | 6/1919 | Pokopac | 15/104.3 R |
| 1,796,340 | 3/1931 | Nowakowski | 15/104.3 SN |
| 1,915,679 | 6/1933 | Motte | 15/104.3 SN |
| 2,182,680 | 12/1939 | Rugg et al. | 15/104.1 R X |
| 2,446,964 | 8/1948 | Stone | 15/104.3 SN |
| 2,454,884 | 11/1948 | Peaden | 15/104.3 R |
| 2,651,067 | 9/1953 | Collison | 15/104.3 SN |
| 2,953,799 | 9/1960 | Arnold | 15/104.3 SN |
| 3,457,580 | 7/1969 | Meyers | 15/104.3 SN |
| 3,589,609 | 6/1971 | Wyant et al. | 15/249 X |
| 3,638,369 | 2/1972 | Albrecht | 15/104.3 R X |

*Primary Examiner*—Charles E. Phillips

*Attorney, Agent, or Firm*—Hollrah, Lange & Thoma

[57] ABSTRACT

A system for cleaning or preventing a sewer and plumbing line system from becoming clogged. Included is a cleaning cable permanently installed in the sewer and plumbing line of a building. The cable being permanently distorted at points along its length and being flexible along the remainder of its length and being connected at the end near a plumbing fixture to a motor for rotation.

7 Claims, 8 Drawing Figures

CITY MAIN
TO CITY MAIN

AUTOMATIC SEWER CLEANING SYSTEM

This application is a continuation-in-part of presently pending U.S. application Ser. No. 071,501, now abandoned filed Aug. 31, 1979.

BACKGROUND OF THE INVENTION

The present invention relates generally to apparatus and methods for preventing the sewer line of a building from becoming clogged and more particularly to apparatus and methods that include the use of a cleaning device permanently installed within the sewer line and that can be rotated periodically.

Present day sewer systems for residential, commercial, industrial and hospital buildings comprise a sewer line attached to the various plumbing fixtures, such as sinks, toilets, showers, bathtubs and drains, such as floor drains, within the building. Because such waste materials often include substantial solids or extremely heavy or coagulating liquids, the sewer line of many buildings often become clogged thereby inhibiting or preventing the flow of waste material through such sewer line away from the building.

Prior to the present invention, numerous devices were developed for unclogging sewer lines after they become clogged. See, e.g., U.S. Pat. Nos. 3,457,580 (issued to Meyers on July 29, 1969), 2,953,799 (issued to Arnold on Sept. 27, 1960), 2,651,067 (issued to Collison on Sept. 8, 1953), 1,915,679 (issued to LaMotte on June 27, 1933) and 1,796,679 (issued to Nowakowski on Mar. 17, 1931). Generally speaking, such devices include a flexible cable having an auger or cutter blades on one end and a means for rotating the cable and auger. In using such devices, the auger or cutter is inserted into the line at an opening in such line, e.g., a sewer line clean out which is provided for such purpose, a drain or a roof vent, and the auger or cutter is then moved through the sewer line by feeding the cable through the opening. The flexibility of the cable enables the cable to negotiate the bends in the sewer line. By using the rotating means, the cutter or auger can be rotated so that it can cut through any clogs in the line. Once the sewer line has been unclogged, the cable and the auger or cutter are pulled out of the sewer line.

Although such lines have proved to be effective in unclogging sewer lines, there still exists at least some "down time" during which the sewer system of the building cannot be used and extending from the time the line becomes clogged until the time the line is unclogged and the cable is removed from the line. In instances where the clogging is severe or the line is long and/or includes many bends, this down time can be substantial. Furthermore, proper operation of such devices often requires the services of a professional plumber who must make a service call thereby increasing the down time and the cost of unclogging the line. In many establishments, such as restaurants, not only do sewer lines become clogged regularly, but also all down time of the sewer system precludes operation of such establishments.

Also prior to the present invention, sewer line cleaning devices which are permanently mounted in the sewer line have been described. See U.S. Pat. Nos. 2,454,884 (issued to Peaden on Nov. 30, 1948) and 2,306,925 (issued to Pokopac et al on June 17, 1919). Because such devices are permanently mounted, as compared to the cable devices described supra, they may have some tendency to eliminate the down time resulting from a clogged sewer line since the steps of inserting and removing the devices are eliminated. The permanently installed devices disclosed in Peaden and Pokopac, however, must be custom designed for each sewer line because the device must have a special joint or gearing apparatus corresponding to each bend in the sewer line. Furthermore, the devices of Peaden and Pokopac must be installed at the time the sewer line is installed. Also, when not in use, the devices of Peaden and Pokopac extend through a substantial portion of the diameter of the sewer line thereby creating a permanent additional and substantial obstruction to the flow of waste material through the line. Thus, the number of times the sewer line become clogged is increased.

SUMMARY OF THE INVENTION

The present invention is an apparatus and method for using the apparatus by which clogging of sewer lines is essentially eliminated thereby reducing down time resulting from clogged sewer lines essentially to zero. The present invention need not be custom designed and may be used readily in any sewer line, existing or new, with no substantial modification of such line. Although the invention includes a device permanently installed in the sewer line, the nature of the device is such that, when the device is not in use, the obstruction to flow created by such device is minimal.

The apparatus of the invention includes (i) a cable permanently installed in the sewer line, the cable being permanently distorted along its length and being flexible along its entire length such that the cable can conform to bends in the sewer line and such that when the cable is not at rest, the cable will lie substantially flat on the bottom of the sewer line, and (ii) a motor coupled to the cable for rotating the cable such that the cable cleans out the sewer line.

The method of the invention includes installing the cable of the apparatus of the invention in a sewer line, connecting one end of such cable to a motor and activating the motor at predetermined time intervals, such that the cable clears out the sewer line.

BRIEF DESCRIPTION OF THE DRAWINGS

For a detailed description of the preferred embodiments of the invention, reference will now be made to the accompanying drawings wherein.

DETAILED DESCRIPTION OF THE PREFERRED EMBODIMENT

Figure 1:
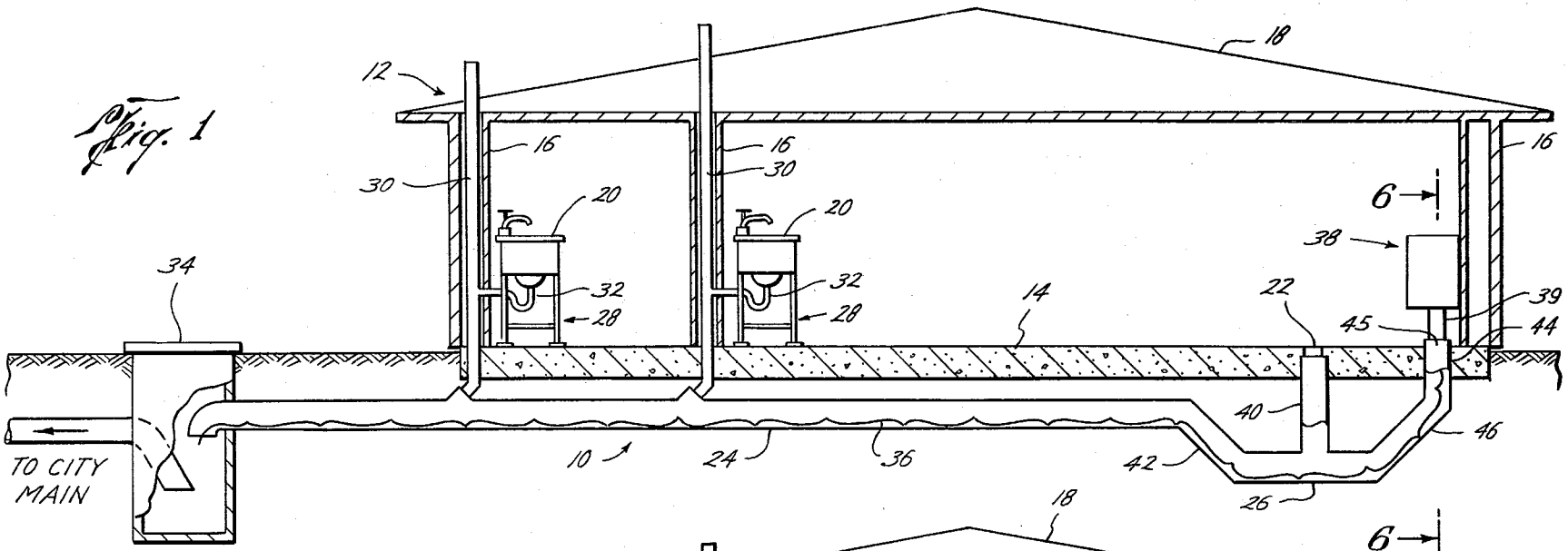
FIG. 1 is a generally schematic representation of the apparatus of the invention installed in a sewer system with the cable of the apparatus at rest.
Figure 2:
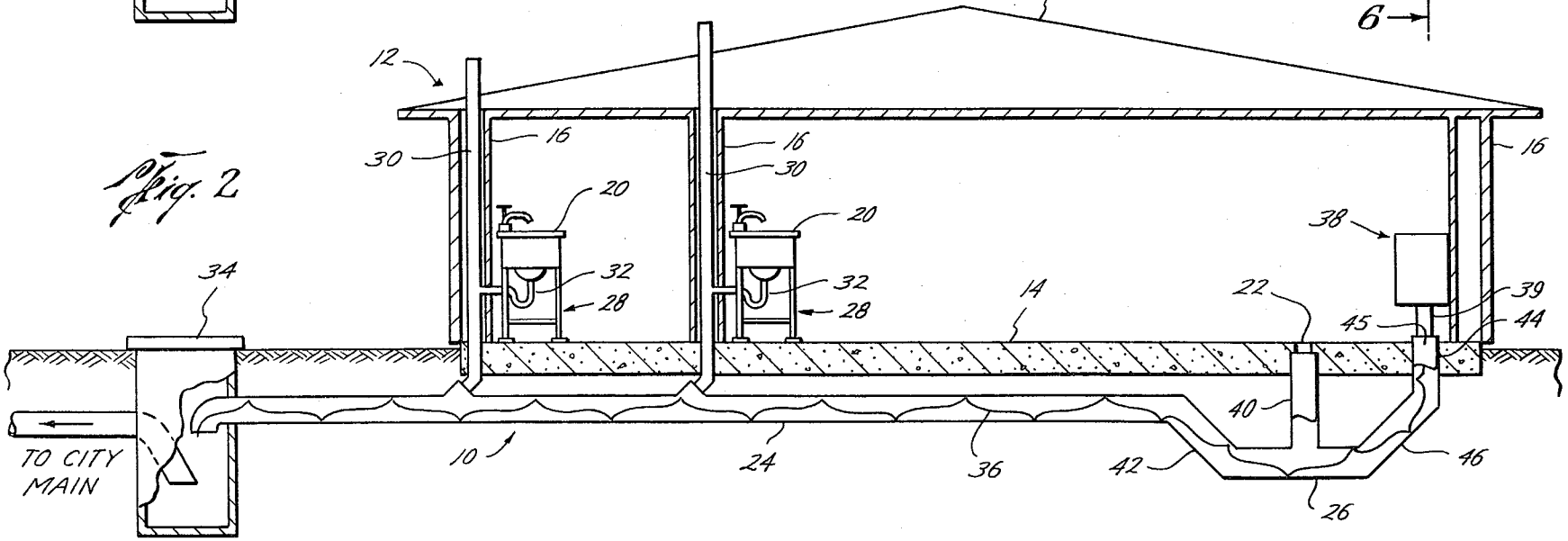
FIG. 2 is the representation of FIG. 1 with the cable of the apparatus being rotated.

FIGS. 1 and 2 show the preferred embodiment of the apparatus of the invention installed in an illustrative sewer system 10 installed in a building 12. Building 12 includes floor 14, a plurality of walls 16, roof 18 and a plurality of plumbing fixtures, such as sinks 20 and floor drains 22, therein. Sewer system 10 includes sewer line 24, generally disposed beneath floor 14, for transporting waste material from building 12, floor drain traps 26 connecting beytween floor drains 22 and sewer line 24, and sink drain systems 28 connecting between sinks 20 and sewer line 24. Sink drain systems 28 include vented feeder pipes 30 extending through wall 16 from above roof 18 to sewer line 24, and sink drain traps 32 connecting the drain of sinks 20 to a feeder pipe 30.

Figures 3, 4, 5:
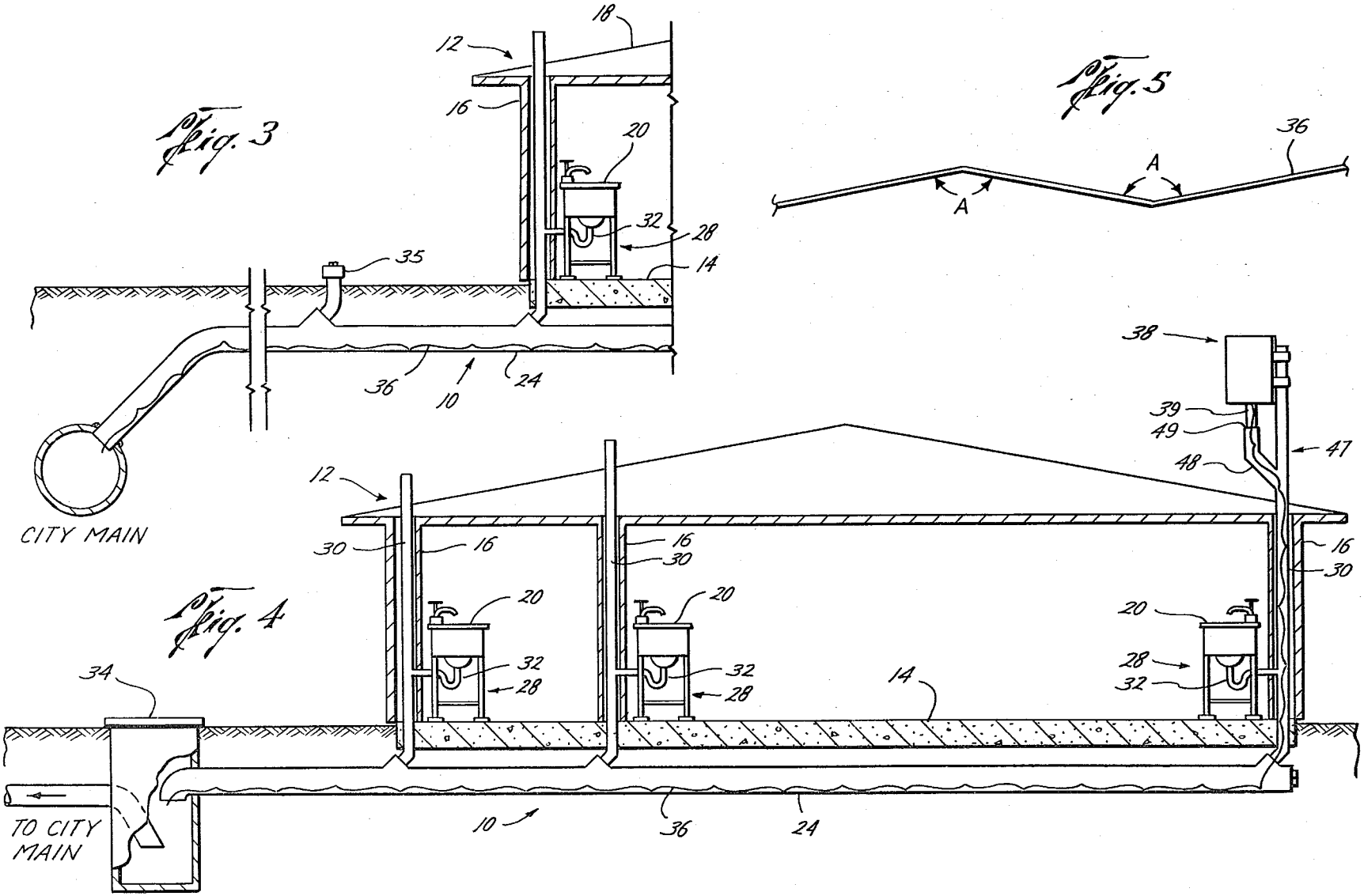
FIG. 3 is a generally schematic representation of a portion of the apparatus of the invention installed in an alternative type of sewer system.
FIG. 4 is a generally schematic representation of the apparatus of the invention installed in a sewer system in an alternative fashion with the cable of the apparatus at rest.
FIG. 5 is an enlarged view of a portion of the cable of the apparatus of the invention, such portion of the cable being set in a position to illustrate the angle to which such cable is kinked.

Outside of building 12 sewer line 24 may be connected to the city sewer main through grease trap 34 as shown in FIGS. 1 and 2. This is a common configuration for restaurants. In other establishments, such as residences and as shown in FIG. 3, sewer line 24 may connect directly to the city sewer main in which case sewer system 10 may further include clean out 35.

The preferred embodiment of the apparatus of the invention includes cable 36 permanently disposed in sewer line 24, drive system 38 for rotating cable 36 and coupling 39 connecting drive system 38 to cable 36.

Because drive system 38, in the preferred embodiment, is disposed outside of sewer line 24 and cable 36 is disposed inside sewer line 24, sewer system 10 preferably is modified to provide an access point at which cable 36 can be connected to drive system 38. Sewer system 10 of FIGS. 1 and 2 has been modified adjacent floor drain 22 by connecting T-connection 40 directly to such drain 22 such that the lowermost point of such T-connection is below the portion of sewer line 24 proximate drain 22, connecting one end of T-connection 40 to sewer line 24 by means of a 45° connection 42, installing ⅛th bend 44 in floor 14 proximate drain 22 such that bend 44 opens upwardly from floor 14 (See FIG. 6), and connecting the other end of T-connection 40 to bend 44 by means of 45° connection 46. With such modification, cable 36 can extend from sewer line 24, through connection 42, T-connection 40, and connection 46 to bend 44, where cable 36 can be connected to drive system 38 by coupling 39. Alternatively, as shown in FIG. 4, sewer system 10 may be modified by adding branch connection 47 having branch 48 with upwardly directed opening 49 to the upper end of vented feeder pipe 30'. With the modification of FIG. 4, cable 36 can extend from sewer line 24, upwardly through feeder pipe 30' to the branch of connection 48 where cable 36 can be connected to system 38 by coupling 39. Although the modification of FIG. 4 is easier and less costly than that of FIGS. 1 and 2, the FIGS. 1 and 2 modification will sometimes be preferred because drive system 38 can be more readily located in a convenient location.

Cable 36 is distorted along its length and has sufficient flexibility such that cable 36 will conform to bends in sewer line 24, such that when cable 36 is rotated, it will extend across a substantial portion of the diameter of sewer line 24 (See FIG. 2) and such that when cable 36 is at rest, that is, not being rotated, cable 36 will lie substantially flat on the bottom of the sewer line (See FIG. 1).

These features can be accomplished by using as cable 36 a cable having a wire rope core and a steel wire wrap. Such cable has been used in the past to move augers or cutters through sewer lines as described in the Background of the Invention, supra. The particular diameter of the cable used will depend on factors such as the diameter of the sewer line, the number of turns in the sewer line, the nature of the sewage material passing through the sewer line and the length of the sewer line. As a general rule, the diameter of cable 36 should increase as the diameter of the sewer line increases, as the length of the sewer line increases, as the number of turns in the sewer line increases and as the weight of the sewage material passing through the sewer line increases. Thus, where all the other factors remain the same, it may be desirable to use a larger diameter cable for a sanitary line than would be desirable in a grease line. As a starting point, for a sewer line 25 feet to 100 feet long and 2 inches to 4 inches in diameter, a General Wire Spring Co. EM3 cable, which has a ½ inch diameter, has been found to be especially useful as cable 36. For other sewer line lengths and diameters, the following table is helpful as a general guide, although additional factors, such as turns and sewage materials, may compel the use of a different diameter cable:

| SEWER LINE | | CABLE | |
|---|---|---|---|
| Length | Diameter | General Wire Spring Co. No. | Diameter |
| 8'–50' | 1¼ to 1½" | HE1 | ¼" |
| 15'–50' | 1¼" to 2" | HE1-A | 5/16" |
| 15'–100' | 1½" to 3" | EM2 | ⅜" |
| 25'–100' | 2" to 4" | EM3 | ½" |
| 25'–100' | 3" to 6" | EM4 | ⅝" |
| 25'–100' | 3" to 10" | EM5 | ¾" |

In some applications, it may be desirable to couple two different diameter cables together. For sewer lines greater than 200 feet in length, it is preferred to use an additional separate cable because, for such lengths, the weight and torque of the cable will be too great to provide the desirable cleaning action.

The cable used as cable 36 is crimped or kinked transverse to its length in alternate directions at angle A of 160° (See FIG. 5) at intervals of about one foot along the length of the cable. It should be noted that FIG. 5 is only for the purpose of illustrating the angle at which cable 36 is kinked or crimped and for showing how cable 36 is crimped in alternate directions. Cable 36, once installed in a sewer line and whether at rest or in operation, will not assume the appearance as shown in FIG. 5. Instead, the weight and flexibility of cable 36 will cause such cable to lie substantially flat on the bottom of sewer line 24 when cable 36 is at rest. The kinks or crimps in cable 36 will prevent cable 36 from lying perfectly flat on the bottom of sewer line 24. When cable 36 is rotated, the rotational action will cause cable 36 to rise from the bottom of sewer line 24 and to spiral such that cable 36 will move back and forth across substantially the entire diameter of sewer line 24.

Drive system 38 includes a prime mover having a rotating output. In the preferred embodiment of the apparatus of the invention, such prime mover is an electric motor. The output shaft of such motor may be connected to a reduction gearing mechanism for increasing the torque output capability of drive system 38.

A motor having sealed reduction gear (such as Dayton-Emerson model 6K303 or Dayton-Emerson model 6K353) has been found to provide desirable results when used in drive system 38. The actual choice of sealed gear motor will vary according to two criteria: (i) the weight of cable 36 and (ii) the diameter of sewer line 24. Generally speaking, the greater the weight of cable 36, the greater the output torque capability of the sealed gear motor should be, and the larger the diameter of sewer line 24, the greater the rpm of the motor should be. For example, as a general rule, for a 100-foot-long-EM3 cable, a sealed gear motor providing 125 in-lb output torque is preferred and for a 200-foot-long-EM3 cable, a sealed gear motor providing 240in-lb output torque is preferred. For a sewer line having a four-inch diameter, the sealed gear motor preferably should provide 30 rpm, and for a sewer line having a six-inch diameter, a sealed gear motor providing 60 rpm is preferred. The precise motor characteristics that will provide the best results, however, will depend on such factors as the particular cable being used, the number of turns in the sewer line and the length of the sewer line. Therefore, the characteristics set forth above are only exemplary. Best results have been achieved by keeping the rpm in the 30–60 rpm range.

Figure 6:
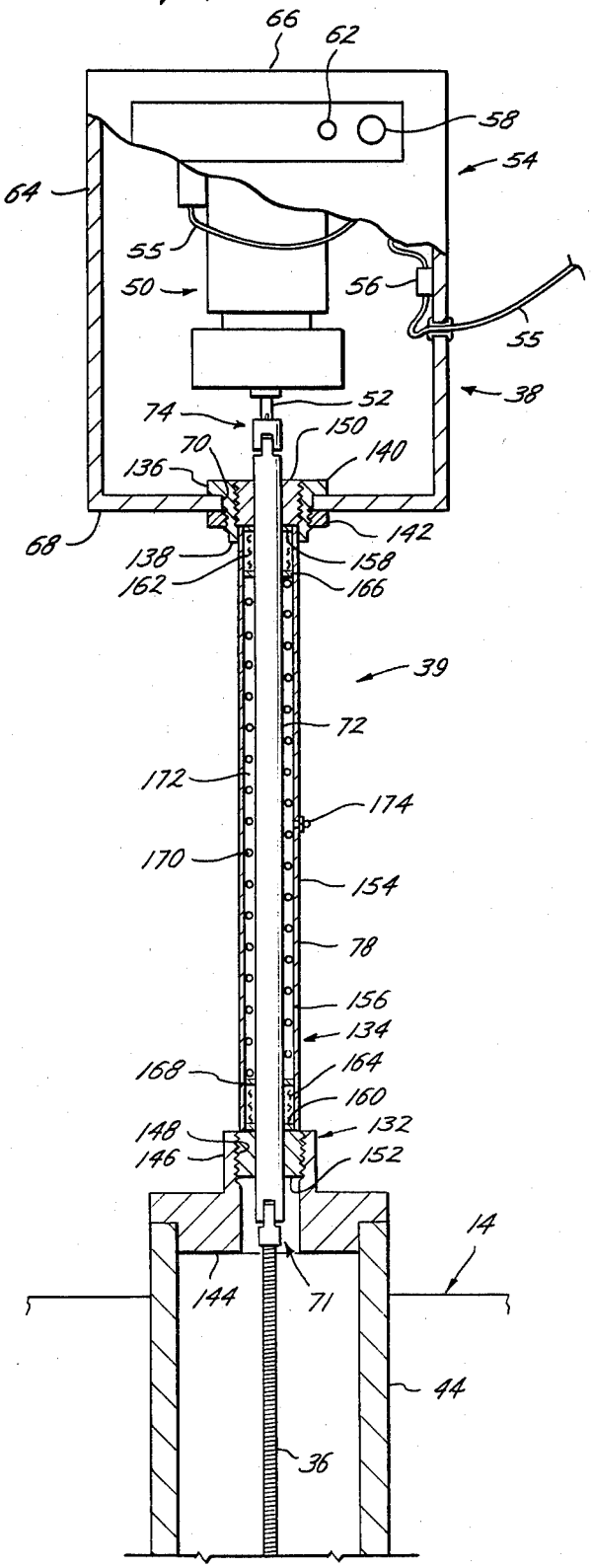
FIG. 6 is a largely sectional view taken along line 6—6 of FIG. 1.

Thus, referring particularly to FIG. 6, drive system 38 of the preferred embodiment of the invention includes sealed gear motor 50 having output shaft 52, which is the output of the reduction gear and has axial surface notch 53 at its tip (See FIG. 8), and power connection system 54 by means of which motor 50 is connected to ac power. Preferably, power connection system 54 includes power line 55 connected to motor 50 through fuse 56 (2 amp for 6K303 Dayton-Emerson motor, 4 amp for 6K353 Dayton-Emerson motor) and timer switch assembly 58. Fuse 56 should break the ac connection whenever the opposing torque of cable 36 prevents rotation of motor 50. Timer switch assembly 58 preferably includes a pushbutton switch in combination with a timer, such as, for example, National Controls Corp. solid state timer T2K-00120-461, and should provide current to motor 50 for approximately 90 seconds after engagement and then cut cut off automatically. System 56 may include a 24-hour timer in place of timer switch 58, such a 24-hour timer providing current to motor 50 for a 90-second interval once per every 24 hour period. Drive system 38 may further include indicator light 62 for indicating that motor 50 is operating. Drive system 38 may also include cabinet 64 within which motor 50 and fuse 56 are disposed and having wall 66 in which the pushbutton of timer switch 58 and indicator light 62 are mounted such that they can be operated and viewed, respectively, from the outside of cabinet 64. Cabinet 64 preferably has a removable cover for permitting access to motor 50 and fuse 56. Furthermore, motor 50 is mounted within cabinet 64 such that output shaft 52 of motor 50 is directed toward, but spaced away from, wall 68 of cabinet 64. Wall 68 has passage 70 therethrough aligned with output shaft 52.

The configuration for coupling 39 should be such that cable 36 will rotate whenever output shaft 52 of motor 50 rotates and will vary principally in accordance with the orientation of motor 50 of drive system 38 with respect to cable 36 and the access point. In the preferred embodiment of the apparatus of the invention, motor 50 of drive system 38 is disposed directly above the access point such that output shaft 52 is aligned with such access point. Furthermore, where drive means 38 includes cabinet 64, coupling 39 of the preferred embodiment may have a configuration that seals off the access point and passage 70 and the space therebetween.

Thus, referring to FIG. 6, coupling 39 of the preferred embodiment of the invention includes cable coupler 71, coupler shaft 72, motor coupler 74, coupler screws 76 and seal apparatus 78.

Figure 7:
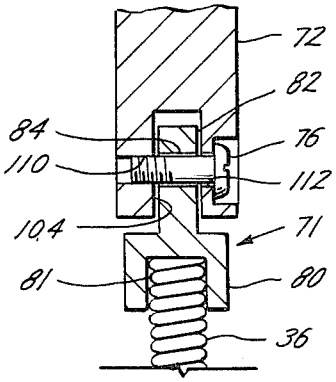
FIG. 7 is an enlarged view of the cable coupler of the apparatus of the invention.

Referring to FIG. 7, cable coupler 71 includes socket portion 80 having opening 81 and flat portion 82 integrally connected to socket portion 80 across the diameter of socket portion 80 and extending away from opening 81. Flat portion 82 has screw passage 84 therethrough. Cable coupler 70 is connected to the end of cable 36 by inserting such end of cable 36 into opening 81 of socket portion 80 and rigidly securing such end of cable 36 therein by welding or other means.

Figure 8:
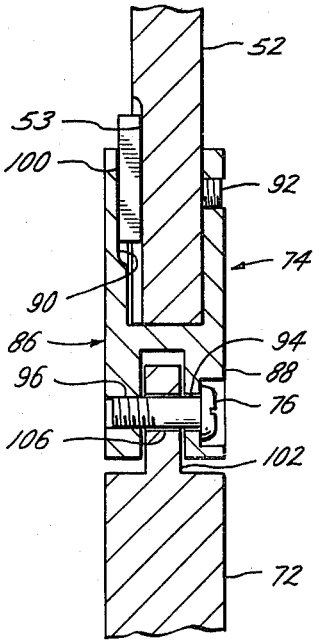
FIG. 8 is an enlarged view of the motor coupler of the apparatus of the invention.

Referring to FIG. 8, motor coupler 74 includes socket portion 86 for receiving output shaft 52 of motor 50 and slotted portion 88 having diametrical slot 90 therein. Socket portion 86 has slot 90 on its inner surface and set screw 92 extending through the wall of socket portion 86. Slotted portion 88 has aligned screw passages 94, 96 therethrough extending transverse to slot 90. Passage 96 is threaded and passage 98 has a larger diameter than passage 96 such that a machine screw can be passed through passage 98 and threaded into passage 96. Motor coupler 74 is secured to output shaft 52 of motor 50 by inserting key 100 into notch 53, sliding socket portion 86 over output shaft 52 such that key 100 engages slot 90, and tightening set screws 92 against output shaft 52.

Coupler shaft 72 is a metal rod secured between motor coupler 74 and cable coupler 70 and includes flat tip 102 at one end for engaging slot 90 motor coupler 74 and slot 104 at the other end for receiving flat portion 82 of cable coupler 71. Tip 102 has screw passage 106 therethrough that is aligned with passages 96, 98 of slotted portion 88 of motor coupler 74. Motor coupler 74 further includes screw 76 extending through passages 94 and 106 and threaded into passage 96 thereby securing coupler shaft 72 to motor coupler 74. Coupler shaft 72 further includes aligned screw passages 110, 112 extending transverse to slot 104, passage 110 being threaded and passage 112 having a diameter greater than that of screw passage 110 such that a screw can be passed through passage 112 and threaded into passage 110. Cable coupler 70 is secured to coupler shaft 72 by inserting flange 82 into slot 104 such that screw passage 84 is aligned with passages 110, 112 and then inserting screw 114 through passages 112 and 84 and threading screw 114 into passage 110.

Seal apparatus 78 includes cabinet bushing 130, pipe reducing bushing 132 and seal tube 134. Cabinet bushing 130 includes (i) male bushing 136 having cylindrical portion 138 and annular flange 140 and (ii) securing nut 142. Cylindrical portion 138 is threaded on both the inside and the outside extends through passage 70 of cabinet 64 such that flange 140 rests against the inside surface of cabinet 64. Nut 142 is threaded onto portion 138 on the outside of cabinet 64 so as to hold male bushing 136 in place. Pipe reducing bushing 132 has (i) large-diameter portion 144 secured within the access point of sewer line 24 (such as the opening of bend 44 as shown in FIG. 6) and (ii) nipple 146 having threaded passage 148. Seal tube 134 includes (i) connector rings 150, 152 disposed over shaft 72 and threadingly received by bushing 136 and nipple 146, respectively, (ii) copper tube 154 having inside diameter greater than the outside diameter of shaft 72 and welded between rings 150, 152 so as to form annular space 156, (iii) steel seal slips 158, 160 disposed against rings 150, 152, respectively, for sealing any space between the inside passage of rings 150, 152 and shaft 72, (iv) graphite packing 162, 164 disposed in annular space 156 adjacent slips 158, 160 respectively, (v) steel seal slips 166, 168 sealing against graphite packing 162, 164, respectively, (vi) compression spring 170 disposed in annular space 156 and bearing against slips 166, 168 so as to compress packing 162, 164, (vii) lubricating grease 172 disposed in annular space 156 between slips 166, 168, and (viii) grease insert 174 through which grease can be forced into space 156.

According to the method of the invention, cable 36 is first kinked or distorted, preferably to the configuration described supra, by applying extreme bending forces to such cable at intervals along its length. The cable is then inserted into sewer line 24. This is best accomplished by inserting an undistorted sewer line cable, such as those discussed in the Background of the Invention, the "pulling cable" into the access point, feeding such pulling cable through sewer line 24 to the grease trap outside the building, as the case may be, attaching the end of cable 36 having cable coupler 71 secured thereto to the end of the pulling cable at the grease trap or clean out, and then pulling cable 36 through the sewer line by pulling the pulling cable out of sewer line 24 at the access point. When cable coupler 71 of cable 36 is pulled through to the access point, the pulling cable is disconnected, cable coupler 71 is secured to coupler shaft 72 and seal apparatus is secured in place.

Drive system 38 is then connected to ac power. As desired, timer switch 50 is activated so that motor 50 will be activated for predetermined length of time. Whenever motor 50 is activated, cable 36 will rotate and will extend across a substantial portion of the diameter of sewer line 24. As cable 36 rotates, it will loosen hardened or clogged sewage material along its entire length thereby clearing sewer line 24. By using a 24-hour timer cable 36 can be made to rotate on a regular daily schedule, such as several seconds per day, complete plugging of sewer line 24 can be prevented thus eliminating down time caused by a plugged sewer line. The actual schedule will depend on the sewer line characteristics and the particular amount and type of waste material carried thereby.

It should be noted that the direction of rotation of the motor should correspond to the direction of the wrap of cable 36. Thus, if the cable has a right-hand wrap, the motor should rotate the cable clockwise and if the cable has a left-hand wrap, the motor should rotate the cable counterclockwise. Such correspondence will keep the cable from tending to back-up in the sewer line as it is being rotated.

Although the apparatus described in detail supra has been found to be most satisfactory and preferred, many variations in structure are possible without departing from the spirit of the invention. Because many varying embodiments fall within the scope of the inventive concept herein disclosed and many modifications may be made to the preferred embodiment herein described in detail in accordance with the descriptive requirements without departing from the invention, the details herein set forth are to be interpreted and understood as illustrative and not in a limiting sense.

I claim:

1. A system for cleaning the sewer line of a building, the sewer line having a plurality of plumbing fixtures connected thereto, the system comprising:

a cleaning cable permanently installed in the sewer line, said cleaning cable being permanently distorted at points along its length in alternate direction about an axis transverse to said length and being flexible along the remainder of its length such that said cable can conform to bends in the sewer line and can conform to a spiral upon rotation and such that when said cable is at rest, said cable will lie substantially flat on the bottom of the sewer line; and drive means for rotating said cable such that said cable cleans out such sewer line, said drive means including a drive system having a rotating output and coupling means for connecting said cable to the rotating output of said drive system.

2. The system of claim 1 wherein said drive means selectively rotates said cable at predetermined time intervals to as to prevent sewage materials from collecting inside the sewer line, such time intervals being determined by the sewer line characteristics and the sewage load carried by the sewer line.

3. The system of claim 2 wherein said drive system includes a timer and a motor, said timer connected to said motor for programming the operation of said motor in accordance with the desired preventive schedule for said sewer line to provide optimum cleaning efficiency.

4. The system of claim 1, wherein said cable has a diameter of approximately ½" and is kinked at spaced intervals to an angle of about 10°.

5. The system of claim 1 wherein said cable is permanently distorted.

6. The system of claim 5 wherein the distortion is created by kinking said cable at spaced intervals along its length.

7. The system of claim 1 wherein said drive system includes a motor mounted in a cabinet and said coupling means includes (i) a shaft extending from said motor to said cable and seal apparatus disposed between said cabinet and such sewer line and surrounding said shaft.

* * * * *